United States Patent [19]

Brunel

[11] Patent Number: 4,698,015

[45] Date of Patent: Oct. 6, 1987

[54] INSTALLATION FOR MONITORING THE FUNCTIONING OF A BOILER

[76] Inventor: Gérald Brunel, 3, rue Traversière, 42100 Saint Etienne, France

[21] Appl. No.: 947,388

[22] Filed: Dec. 29, 1986

[30] Foreign Application Priority Data

Dec. 31, 1985 [FR] France ..... 85 19491

[51] Int. Cl.[4] ..... F23N 5/00

[52] U.S. Cl. ..... 431/76; 236/15 E; 431/116

[58] Field of Search ..... 431/76, 116; 236/15 E

[56] References Cited

U.S. PATENT DOCUMENTS 3,307,613 3/1967 Rexer ..... 431/76

4,395,226 7/1983 Nakanishi et al. ..... 431/76

4,508,501 4/1985 Kuhn ..... 431/76 X

*Primary Examiner*—Edward G. Favors

*Attorney, Agent, or Firm*—Louis Orenbuch; Paul Kudirka

[57] ABSTRACT

An installation for monitoring combustion to control pollution and retard other deleterious effects of improper combustion employs a smoke sampling duct to draw off a portion of the smoke emanation from the combustion chamber. The smoke in the sampling duct flows past a probe and is then vented from the duct. The probe senses oxygen or other substances in the smoke and emits signals to a device which analyzes the quality of combustion. A gas inlet in the sampling duct is situated upstream of the probe and gas is intermittently discharged into that duct to ascertain whether the probe is operating properly.

6 Claims, 4 Drawing Figures

INSTALLATION FOR MONITORING THE FUNCTIONING OF A BOILER

The present invention relates to an installation for monitoring the functioning of a boiler and intended to detect any substantial upset in the boiler, the causes of which may be insufficiently oxidizing combustion.

When a boiler is running under excessively oxidizing conditions, this penalizes the efficiency of combustion and reduces the power which the boiler can supply. Such poor functioning is not disturbing where the safety of the boiler is concerned. For practical purposes, it involves no pollution problems because unburned matter such as CO will be in relatively small quantities.

On the other hand, when a boiler is improperly adjusted and when combustion is not sufficiently oxidizing or is reductive, the consequences are far more troublesome and may be more serious. Indeed, unburned matter appears in the smoke which is reflected in trouble in terms of safety and pollution. Under these conditions, there is an accumulation of carbon monoxide, CO, pollution by carbon monoxide and the other unburned substances, and a risk of deposited soot clogging the boiler. Known safety devices only check the presence of a flame and not the quality of combustion.

The present invention is aimed at providing a monitoring system which makes it possible to check that combustion is not seriously maladjusted and to ascertain whether the probe which performs this supervisory task is operating properly.

Indeed, it is essential that the monitoring system check on the one hand that the analyzing probe is functioning normally and that, on the other, the smoke is oxidizing.

To this end, the present invention relates to an installation for monitoring satisfactory functioning of a boiler, characterized in that it is composed of a smoke sampling duct communicating with the combustion chamber of the boiler and having an outlet to a region of lower pressure, a gas supply having an inlet into the sampling duct upstream of an analyzing probe which detects the smoke flowing towards the outlet and means for causing the gas supply to intermittently discharge gas into the smoke sampling duct to trigger the probe and in order to verify that the probe is in good working order.

This installation, which is of particularly simple construction, makes it possible to continuously ascertain whether the boiler is operating under normal conditions and is not excessively maladjusted.

In the various embodiments here disclosed, the analyzing probe is preferably an oxygen zirconium probe; it is likewise possible to use other pick-ups and probes as well as combinations of probes and pick-ups to detect gaseous unburned matter such as, for example, catarometric probes which make it possible to detect seriously maladjusted combustion in which unburned gaseous substances are emitted because of a large deficiency or a large excess of air.

Generally, the installation according to the invention may be used independently of or associated with a conventional flame monitoring device.

Although the description of the various embodiments has been given hereinabove with regard to the monitoring of oxidizing atmosphere which in certain embodiments utilizes an injection of gas, the installation may likewise be used under contrasting conditions to monitor a reductive type of combustion. In this case, the periodic injection of gas is replaced by an injection of air.

By intermittently and preferably regularly injecting a small quantity of gas, it is possible to swing the probe between its low condition and its high condition. The intermittent signal supplied by the probe may be integrated by the control circuit which, in the case of normal functioning, transmits a corresponding signal and, in cases of abnormal functioning, switches the boiler over to safety, that is to say stops it and prevents it being restarted except after manual intervention.

If the probe emits no signals when gas is injected, this means that the probe is inoperative, or that the servo motor feeding the fluid (gas, air) has failed to respond to the operating signals.

On the other hand, if the control circuit confirms that the probe is working normally and the probe provides a signal which indicates poor functioning of the boiler, this signal is interpreted as such.

This system is not only of interest on account of its simplicity, because it can be produced and easily mounted on new boilers, but since also because it can readily be fitted on existing boilers.

According to a particularly interesting feature, combustion is regulated by a combustion monitoring device with simulation of stoichiometric combustion (control of the value $\lambda$) and it is worth while integrating the monitoring system into this circuit. The regulating probe may be used for periodically detecting poor combustion in the hearth. For this, while the regulator is functioning, there should be a permanent check that the probe is in good condition by ensuring that it oscillates regularly between the two conditions. If it does not, this means either that the probe is inoperative or that the regulator or its motors is/are functioning improperly. In both cases, the boiler and its burner are set to safety. Periodically, if the probe and the regulator are functioning, the valve is opened to allow the intake of smoke from the hearth (the regulator is then stopped) and it is checked that the smoke is oxidizing. If it is not, then the system is set to safety.

In greater detail, this installation is then characterized in that it is composed of a boiler regulating system comprising a gas duct and an air duct, the simulation chamber discharging into the hearth through a smoke duct in which is placed a probe connected to a circuit which controls the gas supply valve, and a duct connecting the simulation chamber to the ventilator supplying the combustion air (or to the smoke jet), this duct being provided with a valve linked to an operating circuit in order intermittently to open the duct and allow smoke to be sucked from the hearth and over the probe.

Although it is of interest in the case of boilers which operate under pressure, that is to say in which the combustion air is supplied by a fan, to fit the monitoring installation as specified hereinabove, this application is not limitative. The installation can according to the invention likewise be fitted to boilers which operate under negative pressure, that is to say in which the combustion air is drawn in by a vacuum.

It may be advantageous to fit the installation in the smoke duct.

For this purpose, according to an advantageous characteristic feature, the installation is mounted in the smoke duct in a boiler and consists of a pipe one end of which constitutes a total take-off placed in the smoke duct and of which the other end is connected to the duct by a static take-off and a gas supply duct provided with a valve operated by a control circuit upstream of the probe so that the probe is continuously exposed to the smoke drawn in through the duct and so that periodically the control circuit causes the valve to be opened so that gas can be injected into the smoke in the duct and tilt the probe, the operating circuit integrating the probe tilt signals in order to check that it is properly functioning.

It is likewise possible to mount the installation according to the invention in a branch pipe on a smoke extractor.

In this case, according to another characteristic feature of the invention, the installation consists of a pipe connected to a smoke duct branched off a smoke extractor, a gas supply provided with a valve equipped with a contol circuit and discharging into the duct in order to inject gas into it on command, and also a probe downstream of the gas injection point, the probe being permanently exposed to the smoke drawn in through the duct by pressure/vacuum downstream and upstream of the extractor and the control circuit which operates intermittently all the valve returns in order to inject gas and cause the probe to tilt in order to check that it is functioning properly, via a monitoring circuit which receives the signals from the probe.

The present invention will be described in greater detail hereinafter with reference to various embodiment which are shown diagrammatically in the appended drawings, in which.

Figure 1:
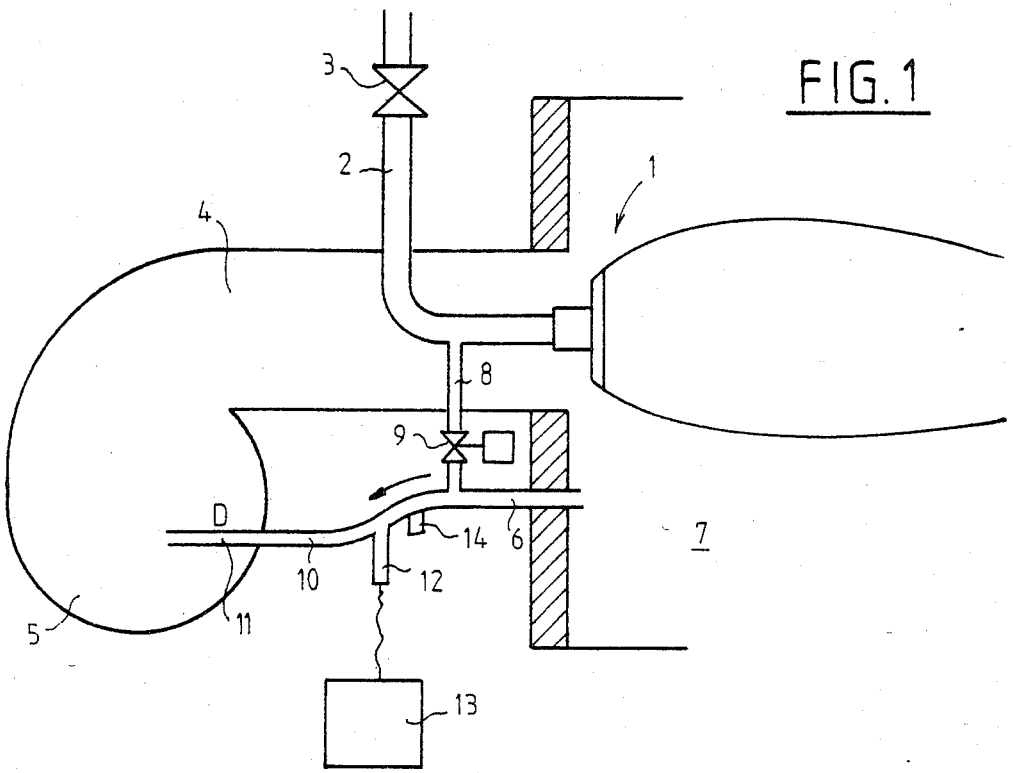
FIG. 1 is a diagram of an installation for monitoring the proper functioning of a boiler.

According to FIG. 1, the installation for monitoring the operation of a boiler of which only the burner 1 is shown together with its gas supply duct 2 provided with a valve 3 and its air supply duct 4 furnished by a fan 5, is composed of a smoke duct 6 discharging into the hearth 7, a gas take-off 8 connected to the gas duct 2 and comprising a check valve 9 of regulable aperture, and a discharge 10 opening out into the fan 5 and comprising a diaphragm 11. The monitoring device likewise comprises a combustion probe 12 connected to an operating circuit 13 (analyzing probe, particularly an oxygen probe) and possibly a combustion catalyst 14 upstream of the probe.

The monitoring installation functions as follows:

The negative pressure generated by the fan 5 in the outlet duct 10 sucks smoke from the hearth 7 through the smoke take-off 6 and periodically sucks combustible gas through the gas take-off 8 and through the valve 9. The diaphragm 11 regulates the rate of flow thus created by the vacuum. The probe 12 detects the oxidizing-reducing state or a state of equilibrium (coefficient $\lambda$) in the mixture formed by the smoke and the combustible gas. The signal is used by the control circuit 13 which signals normal or abnormal functioning of the boiler and if need be resets it to a condition of safety.

Figure 2:
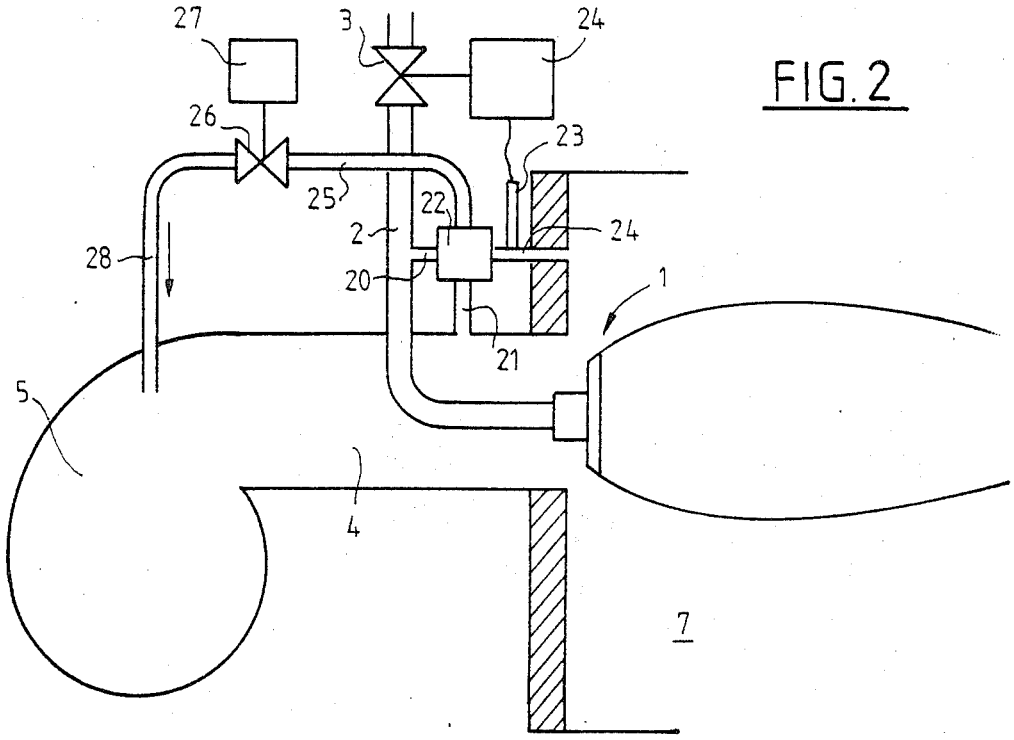
FIG. 2 is a particularly interesting alternative embodiment of the monitoring installation according to the invention.

FIG. 2 shows a particularly interesting embodiment of the monitoring installation shown in FIG. 1. In this drawing, the same references have been used as in FIG. 1 in order to designate the same elements while different references have been used to designate elements having the same function as previously.

In this embodiment, the installation comprises a gas take-off 20 connected to the gas piping, a combustion air take-off 21 connected to the combustion air duct 4 and a simulation chamber 22 in which a stoichiometric combustion is simulated, which is detected by the probe 23 placed in the outlet duct 24 discharging into the hearth 7. This known combustion monitoring installation disclosed in French Patent Application No. FR-A-85 14 605 detects combustion by the probe 23 and regulates the supply of gas via the valve 3 which is operated by the control circuit 24 so that combustion in the hearth 7 takes place under fixed conditions (oxidizing combustion or reductive combustion).

According to the invention, the monitoring installation is composed of a duct 25 connected to the intake of the mechanical blower 5 and comprises a valve 26 operated by a control circuit 27 and a diaphragm 28 which adapts the loss of head to the mechanical blower 5. The dimensioning of the various ducts and pipes 20, 21, 24, 25 and of the diaphragm 28 is such that when the valve 26 is open, the installation operates by drawing smoke through the duct 24 to check that the smoke atmosphere is satisfactory. This check is made intermittently at a frequency governed by the control system 27 which may possibly be integrated in the system 23 of the valve 26.

The regulating probe may be used in order periodically to detect poor combustion in the hearth. For this, while the regulator is functioning, a periodic check is carried out to see that the probe is in good condition by making sure that it regularly swings between its two states. If not, this means either that the probe is inoperative or that the regulator or its motors are malfunctioning. In both cases, the boiler and its burner are switched to a safety condition. Periodically, if the probe and the regulator are functioning, the valve 26 is opened in order to allow smoke to be drawn by a vacuum from the hearth (the regulator is then stopped) and it is checked that the smoke is oxidizing. If not, then the system is switched over to a safety condition.

Figure 3:
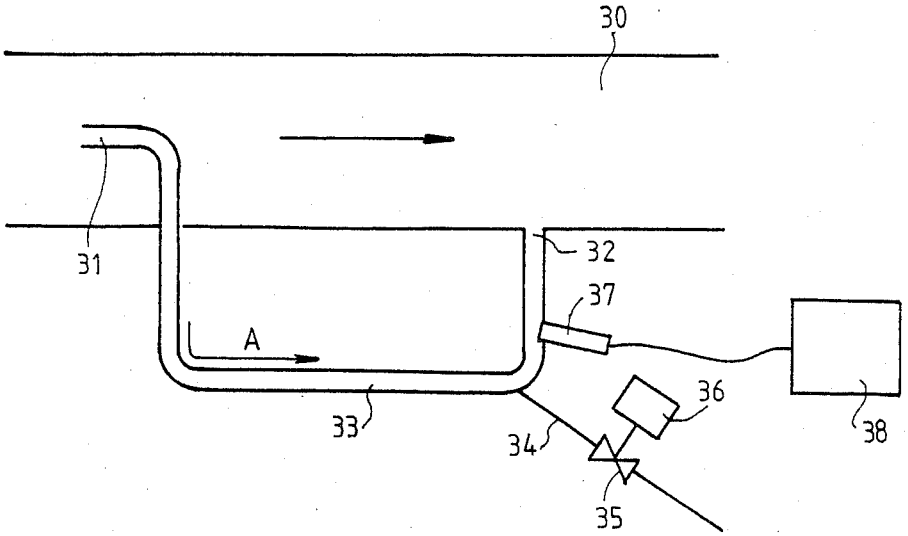
FIG. 3 is a diagram of a monitoring installation according to the invention fitted in a smoke duct.

According to the embodiment shown in FIG. 3, the monitoring installation is mounted in the smoke duct 30 of a boiler. This device employs a smoke sampling duct 33 having a total pressure take-off 31 located in the duct 30 and a static pressure take-off 32 situated where it is exposed to the static pressure in the duct 30. The dynamic pressure which is the difference between these two pressures serves to cause smoke to circulate in the direction indicated by the arrow A in the piping 33. Discharging into this piping is a gas supply 34 controlled by a valve 35 operated by a control circuit 36. This gas supply 34 discharges into the duct 33 upstream of the probe 37.

The probe 37 continuously checks that the smoke circulating in the pipe 33 (and hence in the smoke duct 30) is at all times oxidizing. Functioning of the probe 37 is checked by intermittent and preferably periodic injection of gas through the duct 34 to cause the probe 37 to be tripped. The output signals provided by the probe 37 are utilized by a processing circuit 38 which integrates the signals and checks that they correspond to proper functioning of the probe 37. If functioning is abnormal, the boiler is switched to a safety condition.

Figure 4:
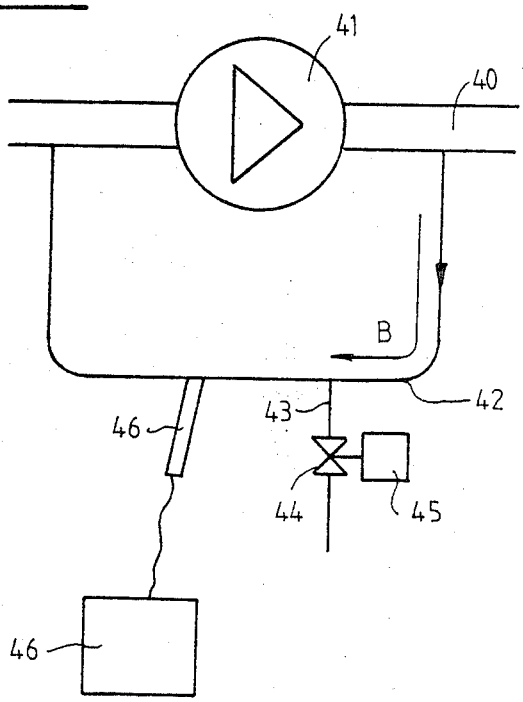
FIG. 4 is a diagram of an installation according to the invention fitted in the combustion air supply duct in a by-pass via the fan.

FIG. 4 shows another alternative embodiment of monitoring installation according to the invention. This installation is fitted in the smoke duct 40 in a by-pass via a smoke extractor 41.

The installation consists of a duct 42 in which smoke circulates in the direction of the arrow B. The installation likewise comprises a gas duct 43 with a valve 44 and a control circuit 45 which makes it possible intermittently to inject a small quantity of gas into the duct 42. Downstream of this gas injection point is a probe 46 which is exposed to the smoke circulating in the pipe 42. Under normal operating conditions, the probe 45 detects the smoke to check that it is oxidizing and intermittently the operation of the probe 46 is checked by sending gas into the smoke through the pipe 43.

Generally speaking, the installation according to the invention may be used independently of or associated with a conventional flame monitoring device.

The installation may also be used for controlling a reduction type of combustion in which case the periodic injection of gas is replaced by an injection of air.

What is claimed is:

1. Apparatus for monitoring the quality of combustion in an installation having a combustion chamber, comprising (1) a smoke sampling duct for drawing off a portion of the smoke emanating from the combustion chamber and causing the smoke to flow through the sampling duct toward a vent, (2) a probe situated where it is exposed to the smoke flowing through the sampling duct, the probe being sensitive to at least one of the substances in the smoke, (3) gas supply means having an outlet for discharging gas onto the sampling duct upstream of the probe, (4) control means for intermittently causing gas from the gas supply means to be discharged into the sampling duct upstream of the probe, and (5) means connected to the probe for ascertaining the operability of the probe.

2. The apparatus according to claim 1 wherein the probe is of the type that is sensitive to oxygen.

3. The apparatus according to claim 1 further comprising (6) a combustion catalyst situated in the smoke sampling duct between the probe and the outlet at which the gas supply means discharges gas into the smoke sampling duct.

4. The apparatus according to claim 1, wherein the smoke sampling duct is arranged to continuously draw off a portion of the smoke emanating from the combustion chamber.

5. The apparatus according to claim 1, wherein the installation has an exhaust duct connected to the combustion chamber through which the smoke generated in the combustion chamber is exhausted and wherein the smoke sampling duct is connected to the exhaust duct and draws off some of the smoke from the exhaust duct.

6. Apparatus for monitoring the quality of combustion in an installation of the kind having a combustion chamber and a combustion simulation chamber for regulating combustion in the combustion chamber, the apparatus comprising (1) a smoke sampling duct having a port to the combustion chamber at one end and being vented to a region of lower pressure at its other end, the smoke sampling duct including the simulation chamber as a portion of the duct, (2) a valve in the smoke sampling duct, (3) means for intermittently opening the valve to cause smoke from the combustion chamber to be drawn into the smoke sampling duct, (4) a sensor probe disposed in the gas sampling duct between the combustion simulation chamber and the port to the combustion chamber, the sensor probe being sensitive to at least one of the substances in the smoke, and (5) means connected to the sensor probe for ascertaining the operability of the probe.

* * * * *